United States Patent [19]

Reardon

[11] Patent Number: 4,577,692

[45] Date of Patent: Mar. 25, 1986

[54] PRESSURE OPERATED TEST VALVE

[75] Inventor: Daniel R. Reardon, Houston, Tex.

[73] Assignee: Hughes Tool Company, Houston, Tex.

[21] Appl. No.: 707,914

[22] Filed: Mar. 4, 1985

[51] Int. Cl.[4] ..... F21B 34/10

[52] U.S. Cl. ..... 166/321; 166/319

[58] Field of Search ..... 166/319, 320, 312, 324, 166/336

[56] References Cited

U.S. PATENT DOCUMENTS

| | | | |
|---|---|---|---|
| 3,824,850 | 7/1974 | Nutter | 73/151 |
| 3,856,085 | 12/1974 | Holden et al. | 166/264 |
| 3,964,544 | 6/1976 | Farley et al. | 166/321 |
| 4,109,724 | 8/1978 | Barrington | 166/321 |
| 4,234,043 | 11/1980 | Roberts | 166/319 |
| 4,341,266 | 7/1982 | Craig | 166/317 |
| 4,378,850 | 4/1983 | Barrington | 166/321 |
| 4,431,051 | 2/1984 | Adams, Jr. | 166/72 |
| 4,489,786 | 12/1984 | Beck | 166/321 |

*Primary Examiner*—Stephen J. Novosad
*Assistant Examiner*—William P. Neuder
*Attorney, Agent, or Firm*—Robert A. Felsman; Charles D. Gunter, Jr.

[57] ABSTRACT

A pressure operated test valve for use in a well test string in a well bore is shown. The test string has a packer arranged for sealing the well bore to isolate the annulus between the well bore and the test string above the packer from that portion of the well bore below the packer. The test valve includes a rotating ball valve which is movable between open and closed positions relative to the interior of the test string. A ball piston shifts the rotating ball between the open and closed positions. A coil spring normally urges the ball piston to its valve closing position. A power fluid reservoir contains a power fluid and an axially shiftable power valve is located within a power chamber which communicates with the power fluid reservoir. An axially slidable control valve is located within a control chamber and has a pressure responsive annular area which is exposed to the power fluid for shifting the control valve. The control valve also has internal passages for supplying pressurized power fluid to the power valve to shift the power valve between a first position which isolates the ball piston and a second position which exposes the ball piston to annulus fluid pressure for shifting the ball to the open position. The well hydrostatic pressure is trapped within a control section of the device prior to setting the packer and provides the reference pressure for subsequent shifting of the valve.

11 Claims, 16 Drawing Figures

PRESSURE OPERATED TEST VALVE

BACKGROUND OF THE INVENTION

1. Field of the Invention

This invention relates to oil and gas well drill stem test tools and, specifically, to an annulus pressure operated test tool for use in a subterranean well.

2. Description of the Prior Art

As oil and gas wells are drilled, the drilling fluid or "mud" serves several important functions. One of the purposes of the mud is to maintain a desired level of hydrostatic pressure upon the formation being drilled to contain formation fluids during drilling. This is accomplished by weighting the mud with various additives so that the resulting hydrostatic pressure of the mud at the formation depth equals or exceeds the formation pressure.

Drill stem test tools are used to test the production capability of the formation. This can be done by lowering a test string into the borehole to the formation depth, and by allowing the formation fluid to flow into the string. A lower pressure can be maintained in the interior of the test string as it is being lowered by keeping a valve closed near the lower end of the test string. Once the appropriate depth has been reached, a packer is set to seal off the surrounding well bore and isolate the formation which is desired to be tested.

The valve at the lower end of the pipe string is then opened, thereby allowing the formation fluid which is isolated from the well hydrostatic pressure to flow into the interior of the pipe string. Various drill stem tests are then conducted which are familiar to those skilled in the art. Such testing typically includes periods of time in which the formation fluid is allowed to flow through the test string, as well as periods of time in which the formation is "closed in." By taking pressure readings during the testing intervals, the production capabilities of the formation can be estimated. After the testing is completed, a circulation valve in the test string is opened to allow the formation fluid in the test string to be withdrawn.

It is often desirable, especially in off-shore locations, to reduce or eliminate test string movement during the drill stem testing operations. This is due to, for example, safety considerations in maintaining the blow-out preventors closed during the testing procedure. Because of the desirability of eliminating movement of the test string, annulus pressure operated devices have been developed. Despite the fact that such devices are operable by annulus pressure with a minimum of test string manipulation, the prior art devices have all suffered from various disadvantages.

U.S. Pat. No. 3,824,850, issued July 23, 1974, to Nutter, shows an early annulus operated valve. The internal valve within the Nutter device was of the sliding sleeve variety and presented in restriction in the internal tubing bore which was undesirable.

U.S. Pat. No. 3,856,085, issued Dec. 24, 1974, to Holden et al, shows an annulus operated valve which utilizes a "full opening" rotatable ball valve to open and close the internal bore of the test string. Although the full opening bore of the tool was an advantage over the Nutter device, the Holden device utilized a valve operating force derived from the action of a trapped inert gas against a piston. This required that the operating personnel on the drilling rig be exposed to high pressure gas when filling and draining the trapped gas system.

Trapped gas systems also require that the proper gas operating pressure be calculated for the test depth prior to inserting the device into the borehole. As a result, any unforseen change in the pressure at the test depth could affect the reliability of the testing device.

SUMMARY OF THE INVENTION

The pressure operated test valve of the invention is designed to be used in a well test string in a well bore. The test string has a packer arranged for sealing the well bore to isolate the well annulus between the well bore and the test string above the packer from that portion of the well bore below the packer. The test valve includes a rotating ball valve which is movable between open and closed positions relative to the interior of the test string. A ball piston shifts the rotating ball between open and closed positions. A spring is provided for normally urging the ball piston to its valve closing position and for providing the primary closing force for the ball.

The test valve also includes a power fluid reservoir which contains a power fluid. An axially shiftable power valve is located within a power chamber and has opposed piston faces which are exposed by means of fluid passageways to fluid in the power fluid reservoir. An axially slidable control valve located within a control chamber has a pressure responsive annular area which is exposed to the power fluid for shifting the control valve. The control valve also has internal passages for supplying pressurized power fluid to a selected face of the power valve to shift the power valve between a first position which isolates the ball piston and a second position which exposes the ball piston to annulus fluid pressure for shifting the ball to the open position.

A control fluid reservoir in the device contains an isolated control fluid. The control fluid reservoir is connected to the control chamber whereby movement of the control valve within the control chamber results in a volume displacement of control fluid within the control fluid reservoir. Pressure responsive means are provided for maintaining the pressure of the control fluid at the level of the well hydrostatic pressure prior to setting the packer to thereby resist the volume displacement caused by movement of the control valve. The pressure responsive means also trap the well hydrostatic pressure into the control fluid reservoir after setting the packer, whereby shifting the control valve requires further pressurization of the control fluid above the existing well hydrostatic pressure.

The additional pressurization is accomplished by a well fluid isolation piston in a piston chamber. The isolation piston has opposed piston faces. One of the faces is exposed to well hydrostatic pressure and the other of the piston faces is exposed to the power fluid for further pressurizing the power fluid to shift the control valve, power valve and ball piston.

The pressure responsive means includes a floating piston in a piston chamber. The floating piston has a first face which is exposed to tubing pressure within the tubing string and a second face which is exposed to control fluid in the control fluid reservoir. A fluid passage communicates control fluid from the control fluid reservoir to the floating piston second face. Metering means, such as a check valve, are provided in a portion of fluid passage for allowing the flow of control fluid pressurized by the floating piston into the control fluid reservoir, while resisting opposite relative flow of the pressurized control fluid.

Because the control fluid is a substantially incompressible liquid, a plurality of spring-loaded displacement pistons are utilized to absorb the volume displacement caused by movement of the control valve within the control fluid reservoir. Each of the displacement pistons has a pressure responsive area which is exposed to the control fluid pressure within the control fluid reservoir. An increase in the control fluid pressure is transmitted to the pressure responsive area of the displacement pistons causing the pistons to compress a spring contained within an atmospheric chamber.

The pressure operated valve of the invention does not require any manipulation of the test string prior to opening the ball valve. Because the control valve operates against trapped hydrostatic pressure, it is not necessary to calculate the expected formation pressure which will be encountered to calibrate a charged gas chamber as was done in the past. The use of the spring loaded displacement pistons in the control fluid reservoir provides a valve operating force which is not derived from the action of a trapped inert gas against a piston.

Additional objects, features and advantages will be apparent in the written description which follows.

DETAILED DESCRIPTION OF THE INVENTION

Figure 4:
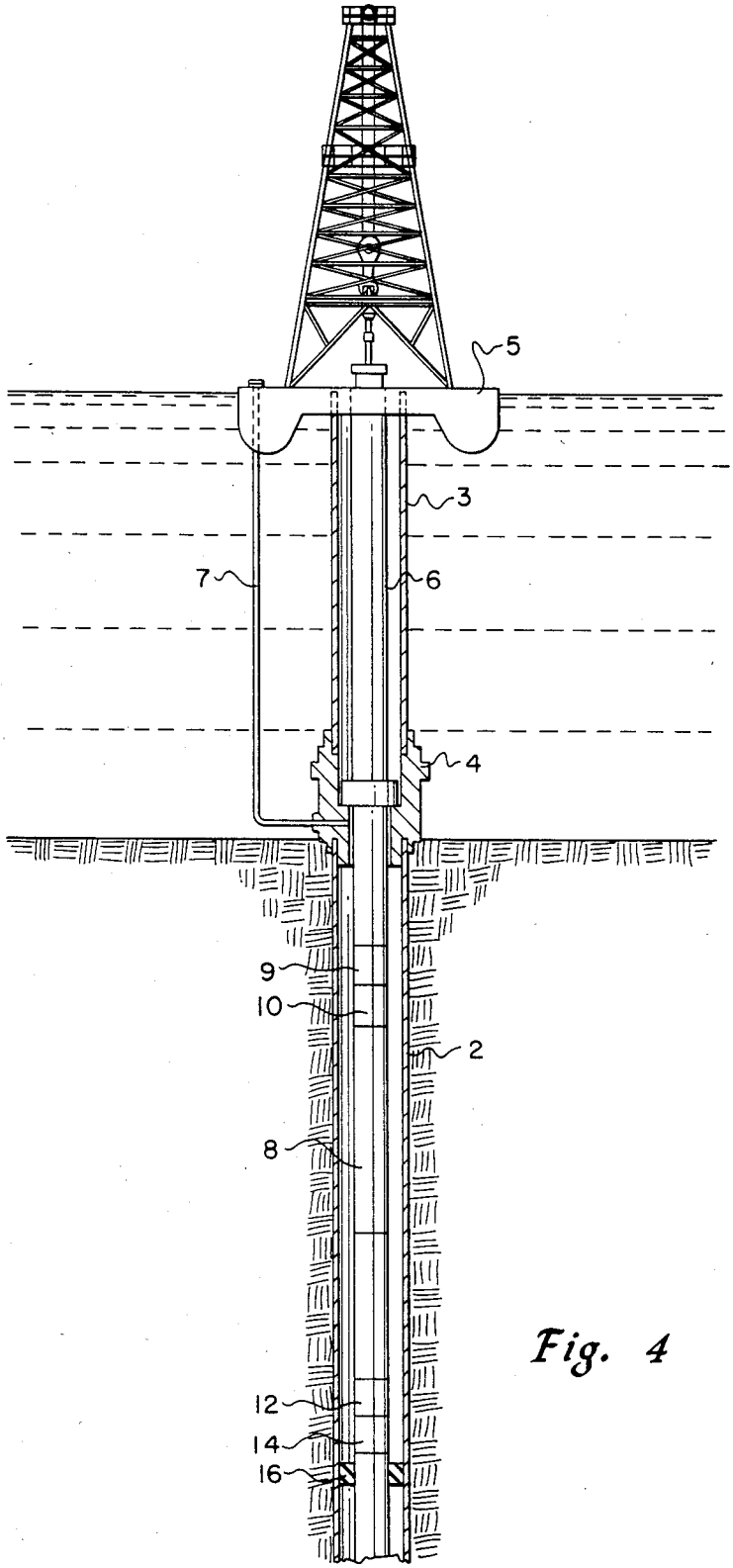
FIG. 4 is a schematic view of a conventional drill stem test tool arrangement which incorporates the pressure operated test valve of the invention.

The pressure operated test valve of the invention is ideally suited for use in an offshore well location. FIG. 4 shows such a typical well location, in schematic fashion. Such wells may be open holes, but are usually cased, as at 2. A riser 3 normally extends from the subsea well head assembly 4 upward to a floating drill rig or platform which is anchored on location and which is used to mount the pumps, hoist and other mechanisms normally employed in well testing. The testing string 6 extends from the drill rig downward into the well. The well derrick has a platform on which is mounted conventional hoisting equipment which is utilized to insert and remove the pipe string from the well. A supply conduit 7 is utilized to transmit mud to the well annulus between the testing string and to the casing at a point below the blow-out preventors, which are incorporated into the well head. Mud pumps on the platform are provided to pressurize the mud in the supply conduit.

The formation testing string itself, in addition to the pressure operated test valve 8, can include other conventional components such as drill collars 9, a reversing valve 10, a safety joint 12, and a pressure recorder 14. A packer 16 is arranged for sealing the well bore to isolate the well annulus between the well bore and the test string above the packer from that portion of the well bore below the packer.

FIGS. 1A–1E illustrate a pressure operated test valve 8 of the invention designed to be incorporated in a well test string for use in a conventional formation testing set-up, as previously described. The test valve of the invention is comprised of four basic sections which will be discussed in order.

THE BALL VALVE SECTION

Figure 1A:
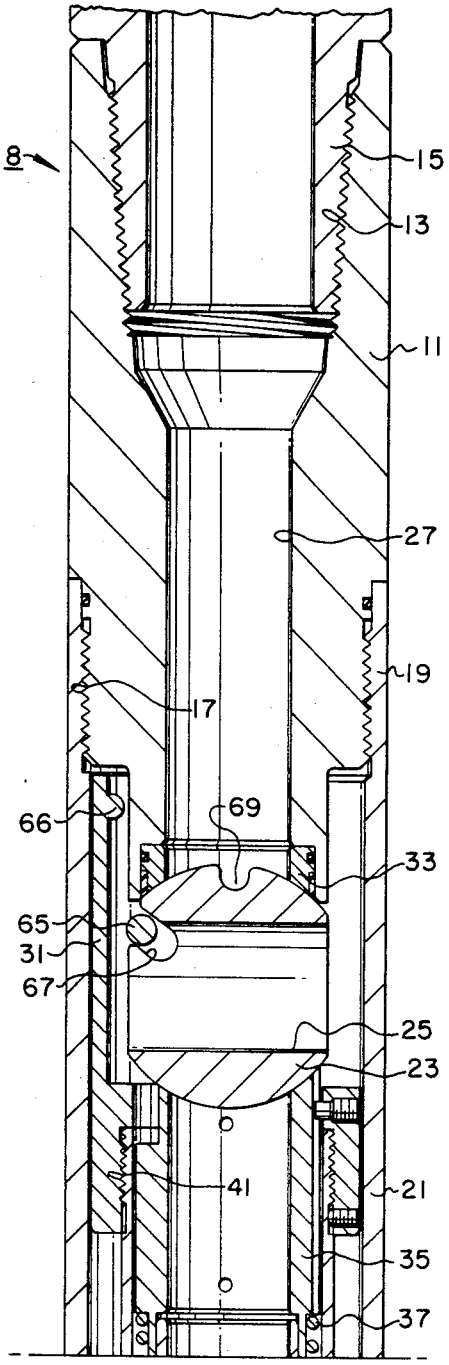
FIGS. 1A–1E are successive downward continuations showing side, cross-sectional views of the pressure operated test valve of the invention in the running-in position.
Figure 1B:
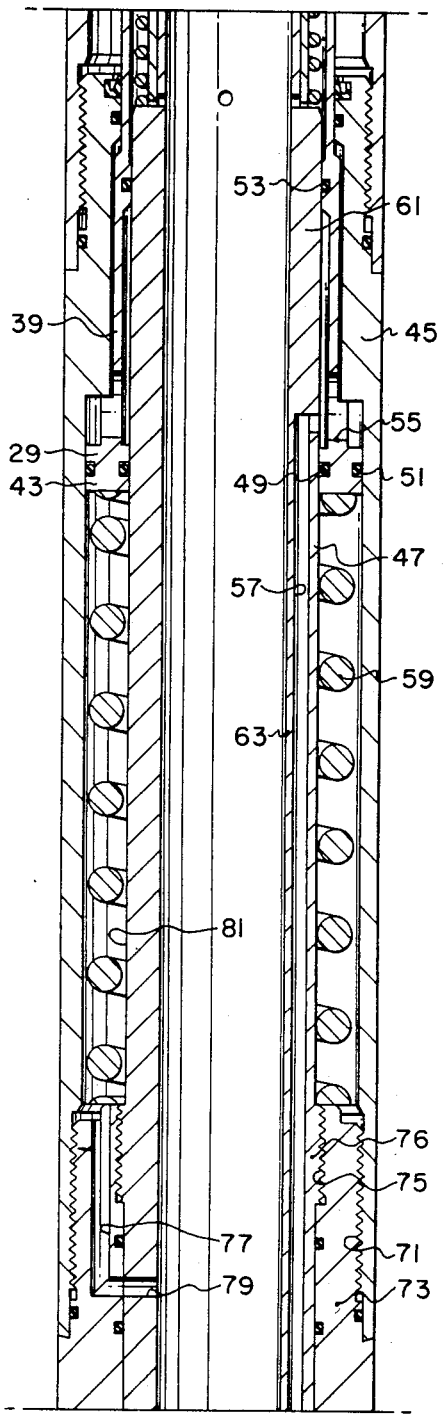

FIGS. 1A–1B illustrate the ball valve section of the device in the running-up position. The device includes a top sub 11 having an internally threaded extent 13 which is adapted to matingly engage the externally threaded lower extent 15 of the well pipe string extending to the surface. The top sub 11 has a threaded outer extent 17 which is adapted to engage the internally threaded upper end 19 of a cylindrical ball housing 21.

Within the ball housing 21 is contained a rotatable hollow ball 23 containing an aperture 25 which is substantially the same size as the internal bore 27 which extends longitudinally through the testing tool. A sleeve type actuating piston 29 (FIG. 1B), provided with a yoke 31, serves to rotate the ball valve 23 from the closed position shown in FIG. 1A to the open position shown in FIG. 2A by vertical downward movement of the ball piston 29. The ball valve 23 is retained between a top ball seat 33 and a bottom ball seat 35. A seat spring 37 biases the ball in the direction of the top ball seat 33.

As shown in FIG. 1B, the ball piston 29 includes an integral sleeve 39 having an upper threaded extent 41 which engages the yoke 31 for reciprocating the yoke and thereby shifting the ball valve 23. The sleeve portion 39 of the ball piston 29 terminates, at the lower extent, in a circumferential piston portion 43 which forms a sliding seal between an outer ball piston housing 45 and an inner ball piston mandrel 47. Interior and exterior O-ring seals 49, 51 on the circumferential piston portion 43, as well as an interior O-ring 53 on the sleeve portion 39 provide a pressure responsive area 55 in a cut-away portion above the piston portion 43. The pressure responsive area 55 is exposed to fluid pressure in a passage 57 to shift the ball piston 29 downwardly against a ball spring 59. The passage 57 is formed in the interior of the tool between the ball piston mandrel 47 and the lower cylindrical portion 63 of an interior mandrel 61.

Figure 2A:
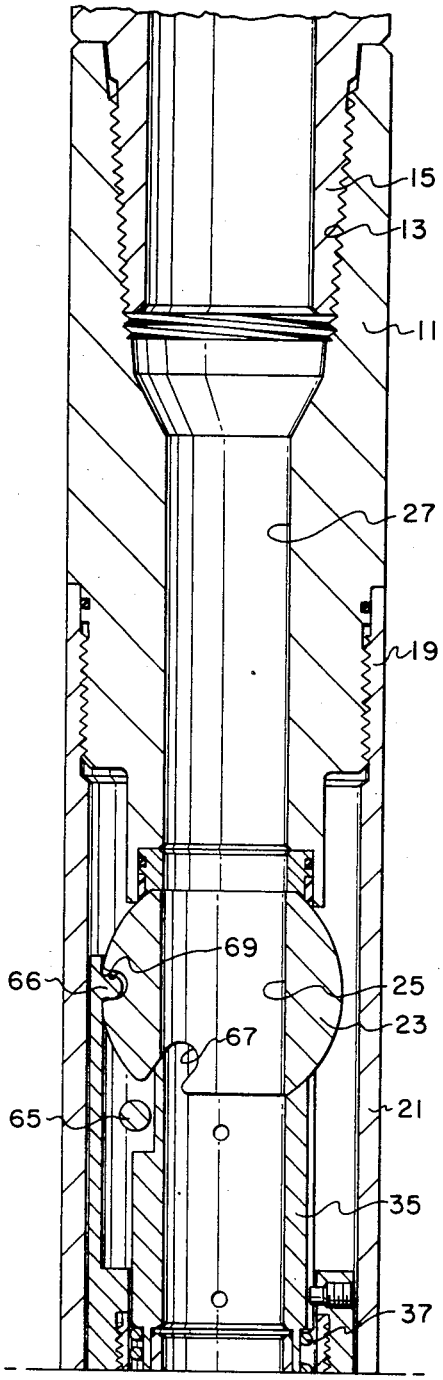
FIGS. 2A–2E are successive downward continuations showing side, cross-sectional views of the pressure operated test valve of the invention after the packer has been set in the well bore and the annulus fluid pressure has been increased sufficiently to cause opening of the ball valve.

Thus, by communicating pressurized fluid to the passage 57, the ball piston 29 can be shifted downwardly, compressing spring 59, and shifting the ball valve 23 between the closed position shown in FIG. 1A and the open position shown in FIG. 2A. The piston 29 operates the rotary ball valve 23 through the cooperation of a pair of pins 65, 66 carried by the yoke 31 with a pair of slots 67, 69 formed in the external periphery of the rotary ball valve 23. Thus, downward movement of the piston 29 effects a rotation of the ball valve 23 about a horizontal axis to bring the central aperture 25 into alignment with the bore 27 provided in the center of the test tool, as shown in FIG. 2A.

As shown in FIG. 1B, the ball piston housing 45 has an internally threaded end 71 which threadedly engages a cylindrical control housing 73. The control housing 73 has an internally threaded end 75 which threadedly engages a portion 76 of the ball piston mandrel 47. At one point in the circumference of the cylindrical control housing 73, an internal passage 77 communicates the interior bore 27 of the tool by means of port 79 with the ball spring chamber 81. The means for providing pressurized fluid in the passage 57 for shifting the ball valve 23 will be explained with reference to the control section of the device.

THE CONTROL SECTION

Figure 1C:
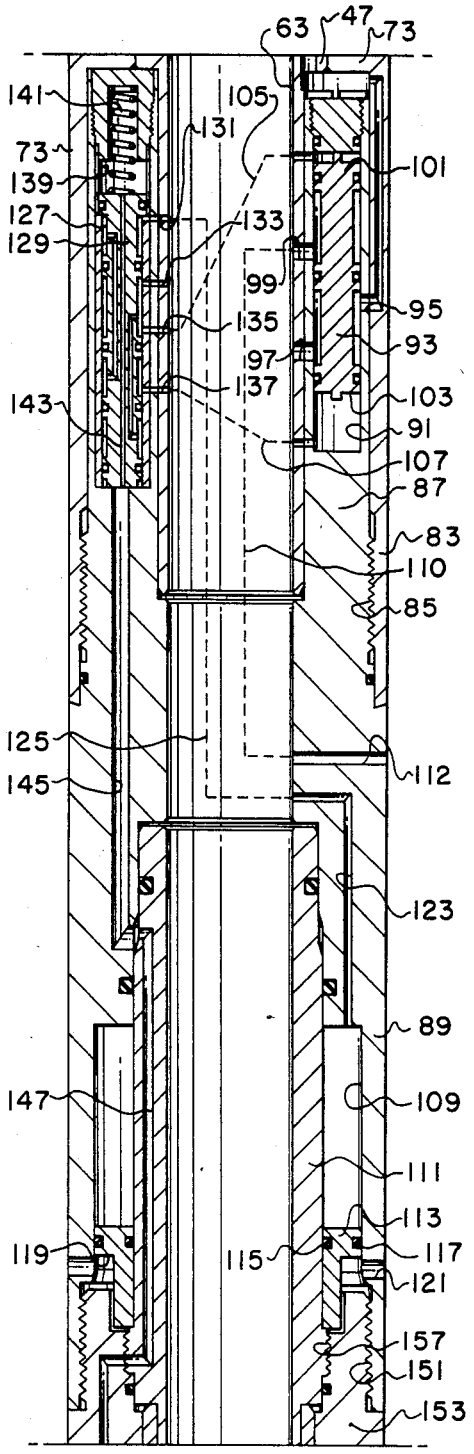
Figure 1D:
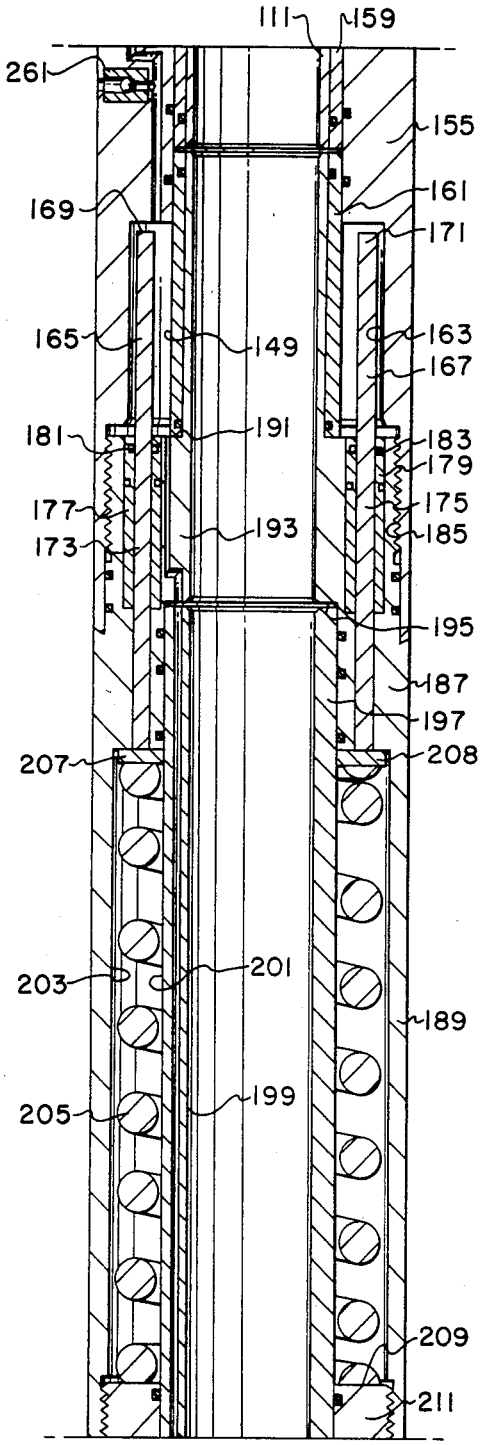
Figure 1E:
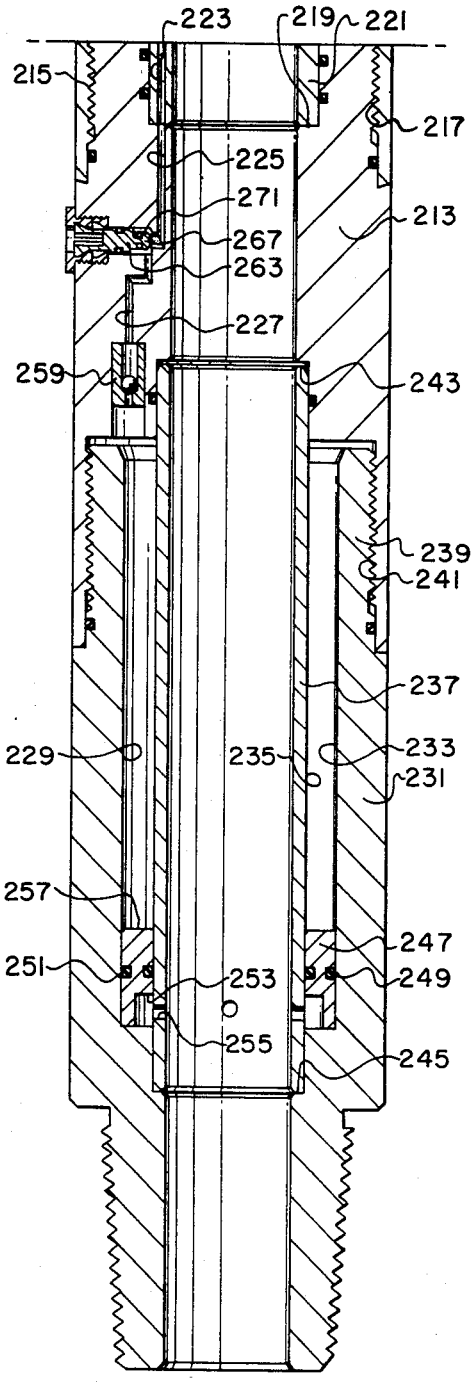

With reference to FIGS. 1C–1E, the control section of the tool will be described. As shown in FIG. 1C, the cylindrical control housing 73 has a lower end 83 having internal threads 85 for engaging the upper end 87 of an isolation piston housing 89. The upper end 87 of the housing 89 includes, at one circumferential location, a power chamber 91 containing an axially shiftable power valve 93. The power valve 93 is a two position, three port valve which controls the flow of fluid through ports 95, 97 and 99. The power valve 93 is a generally cylindrical member having opposed piston faces 101, 103 which are exposed by means of fluid conduits 105, 107 (shown in dotted lines in FIG. 1C) to fluid in a power fluid reservoir 109, as will be described. Port 99 in the power chamber 91 is also exposed to fluid pressure in the well annulus through fluid conduit 110 and orifice 112 in the piston 1 housing 89.

The power fluid reservoir 109 is formed between the side wall of the isolation piston housing 89 and an internal isolation piston mandrel 111. An annular isolation piston 113 is located at the lower extent of reservoir 109 and includes internal and external O-rings 115, 117 for forming a sliding seal with the respective side walls of the reservoir 109. The reservoir 109 is filled with a substantially incompressible fluid, such as oil. The lower piston face 119 of the isolation piston 113 is exposed to pressure in the well annulus by means of ports 121.

The power fluid reservoir 109 communicates by means of an internal passage 123 in the isolation piston housing 89, and by means of a fluid conduit 125 (shown in dotted lines in FIG. 1C) with a pressure responsive annular area 127 of an axially slidable control valve 129. The control valve 129 is a two position, four port valve which controls the flow fluid through ports 131, 133, 135, and 137. The control valve 129 is located within a control chamber 139. The control chamber 139 is filled with a substantially incompressible fluid, such as oil, which communicates by means of bore 143 in the control valve 129, fluid passage 145 in the isolation piston housing 89, and by means of a fluid passage 147 in the isolation piston mandrel 111 with a displacement piston chamber 149 (FIG. 1D). The control valve 129 is spring biased by means of a coil spring 141 toward a first position, shown in FIG. 1C, which isolates the ball piston 29 from the pressure of fluid in the well annulus. The control valve 129 is shiftable upwardly to a second position shown in FIG. 2C which exposes the ball piston 29 to annulus fluid pressure for shifting the ball valve 23 to the open position.

Figure 2B:
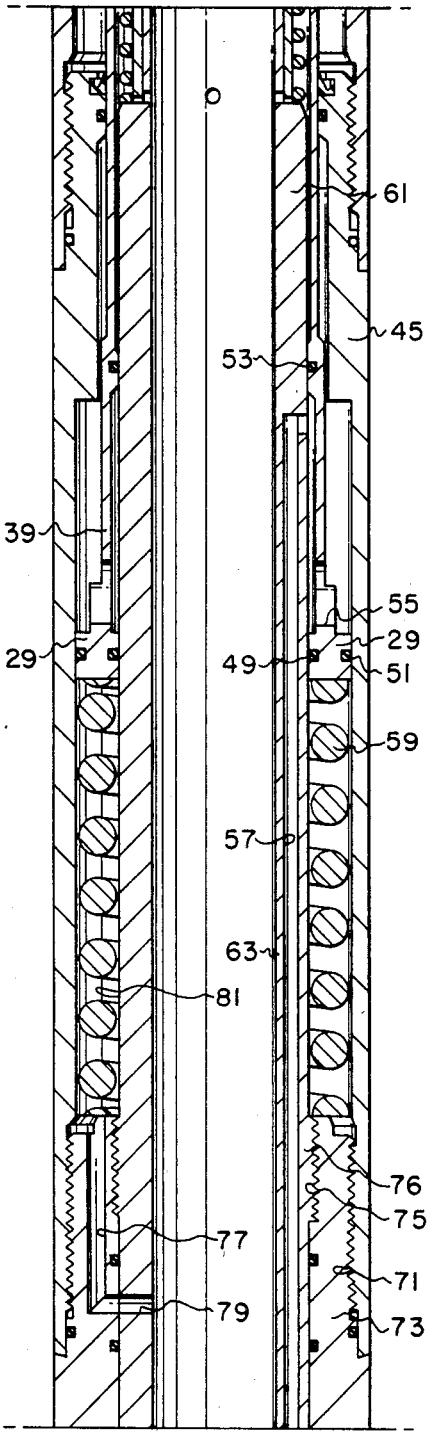
Figure 2C:
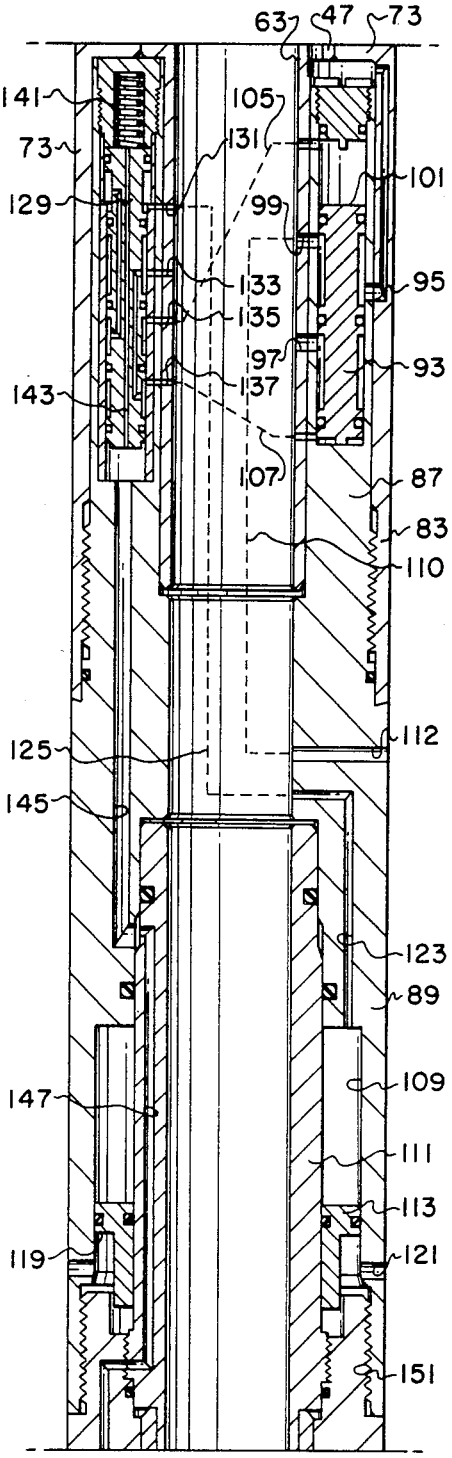

This is accomplished by the application of pressure through conduit 125 to the pressure responsive areas 127 of the control valve 129 to shift the control valve 129 from the position shown in FIG. 1C to the position shown in FIG. 2C. This action supplies power fluid through port 135 and conduit 105 to the piston face 101 of the power valve 93, shifting the power valve 93 downwardly to the position shown in FIG. 2C. Power fluid in the power chamber 91 is partially vented through conduit 107 and port 133 to the interior bore of the tool, to allow the power valve 93 to shift.

Shifting the power valve 93 from the position shown in FIG. 1C to the position shown in FIG. 2C allows the communication of well annulus pressure through orifice 112, conduit 110, port 99, port 95 and passage 57 to the ball piston pressure responsive area (55 in FIG. 1B) to shift the ball.

THE HYDROSTATIC PRESSURE SECTION

The hydrostatic pressure section of the device will be described with reference to FIGS. 1C–1E. As shown in FIG. 1C, the isolation piston housing 89 has an internally threaded lower extent 151 for engaging the externally threaded end 153 of a displacement piston housing 155. The end 153 also has an internally threaded surface 157 for threadedly engaging a portion of the isolation piston mandrel 111. An isolation mandrel sleeve 159 (FIG. 1D) is located between the interior bore of the displacement piston housing 155 and the isolation piston mandrel 111. A spring housing sleeve 161 is located below the isolation mandrel sleeve 159. The spring housing sleeve 161, together with the interior side wall 163 of the displacement piston housing 155, form the annular displacement piston chamber 149.

A series of eight displacement or balance pistons, two of which are shown in FIG. 1D as 165, 167, have upper ends 169, 171 contained within the displacement piston chamber 149. The displacement pistons 165, 167 have mid portions 173, 175 which, in the position shown in FIG. 1D, are contained within piston sleeves 177, 179. One or more sets of O-rings 181, 183 form a sliding seal with the axially slidable displacement pistons 165, 167.

The displacement piston housing 155 has a lower threaded extent 185 which threadedly engages the upper end 187 of a spring housing 189. The spring housing sleeve 161 which forms the interior wall of the chamber 149, is supported upon a shoulder 191 of an internal mandrel 193. The internal mandrel 193 has an under cut area 195 for receiving the upper end 197 of a by-pass mandrel 199.

The outer wall 201 of the by-pass mandrel 199, together with the interior bore 203 of the spring housing 189, form an atmospheric pressure chamber containing a coil spring 205. Displacement of the pistons 165, 167 by fluid pressure in the chamber 149 acts through the spring spacers 207, 208 to compress the spring 205 against a lower abutment 209.

The lower abutment 209 is formed by the upper end 211 of a check valve housing 213. Check valve housing 213 has a threaded outer extent 215 for engaging the lower internal threads 217 of the spring housing 189. An internal profile 219 (FIG. 1E) formed within the check valve housing 213 receives the lower end 221 of the by-pass mandrel 199. A fluid passage 223 formed at one circumferential location within the by-pass mandrel 199 communicates with the displacement piston chamber 149 and through fluid passages 225, 227, formed in the check valve housing 213, with a floating piston chamber 229.

The floating piston chamber 229 is formed in a bottom sub 231 between the interior bore 233 of the sub and the external sidewall 235 of a bottom mandrel 237. The bottom sub 231 has an upper threaded extent 239 for engaging mating internal threads 241 of the check valve housing 213. The bottom mandrel 237 is retained between a shoulder 243 in the bore of the housing 213 and a shoulder 245 in the bore of the bottom sub 231.

An annular floating piston 247 is located at one end of the piston chamber 229 and includes O-rings 249, 251 for forming a sliding seal with the bottom sub and bottom mandrel walls. A substantially incompressible fluid, such as oil, is located within the piston chamber 229, fluid passages 223, 225, 227, and in the displacement piston chamber 149. The floating piston 247 has a first face 253 exposed to tubing pressure within the tubing string through orifices 255 and a second face 257 exposed to the incompressible fluid in the piston chamber 229.

Metering means, including internal check valve 259, in a portion of the fluid passage 227 allow the flow of control fluid pressurized by the floating piston 247 into the displacement piston chamber 149 (FIG. 1D) and control chamber 139 (FIG. 1C), while resisting opposite relative flow of pressurized control fluid from passage 227 to piston chamber 229. A second check valve 261 (FIG. 1D) allows control fluid to flow outwardly into the well annulus when the pressure in the control fluid section of the tool exceeds the well hydrostatic pressure but resists opposite relative fluid flow.

A collet-piston 263 is located within a portion of the fluid passages 225, 227 for trapping hydrostatic pressure within the control fluid reservoir made up of the control chamber 139, fluid passages 145, 147, displacement piston chamber 149, and fluid passages 223, 225, Collet-piston 263 has an outer face 265 exposed to well hydrostatic pressure and a sealing nose 267. In the position shown in FIG. 1E, the collet-piston 263 allows control fluid in the piston chamber 229 to flow into the control fluid reservoir. Once the test depth is reached and the packer is set, subsequent pressurization of the well annulus from the surface causes the collet-piston 263 to move to the position shown in FIG. 2E to block the flow of fluid from passage 225. The collet-portion 269 of the collet-piston 263 is engaged within mating recesses in the collet-piston chamber 271 when well annulus pressure exceeds the fluid pressure in the control fluid reservoir, thereby locking the collet-piston 263 in the closed position and "trapping" well hydrostatic pressure within the control fluid reservoir.

OPERATION

The operation of the annulus pressure operated test tool of the invention will now be described. FIGS. 1A–1E show the condition of the tool in the running-in position. As the tool is lowered into the well bore, hydrostatic pressure from the well bore enters the orifices (255 in FIG. 1E) at the lower end of the tool internal diameter and acts upon the face 253 of the floating piston 247. Piston 247 moves upwardly within the piston chamber 229, thereby compressing the fluid and causing fluid to pass through the check valve 259, pass the collet-piston 263, and through the fluid passages 223, 225, through the displacement piston chamber 149 and through fluid passages 145, 147 to increase the fluid pressure in the control chamber 139.

Figure 2D:
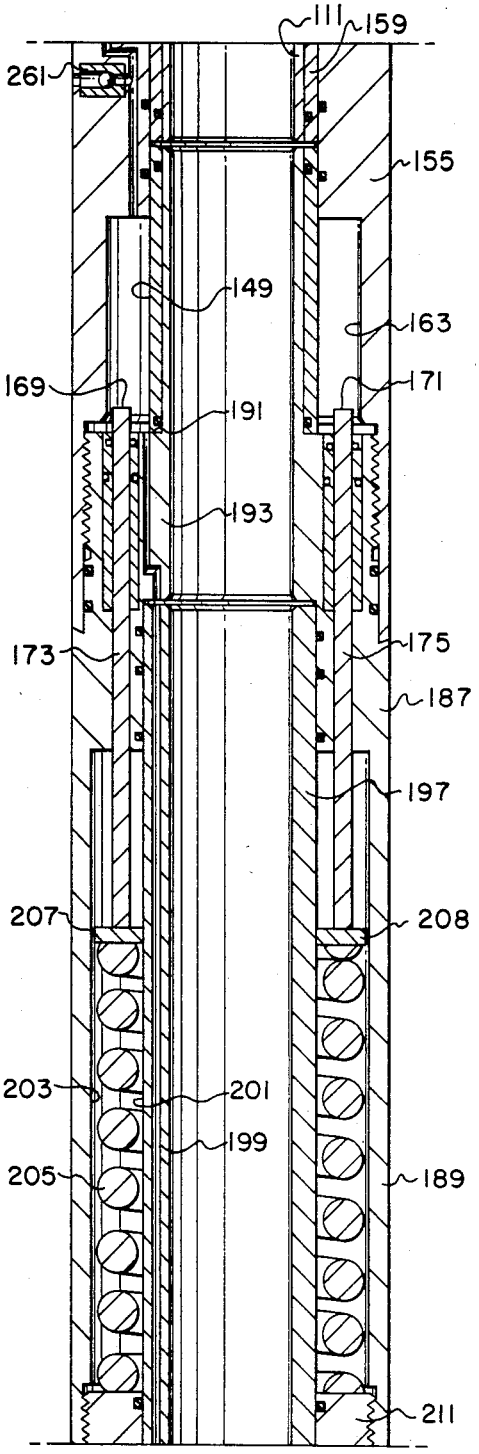
Figure 2E:
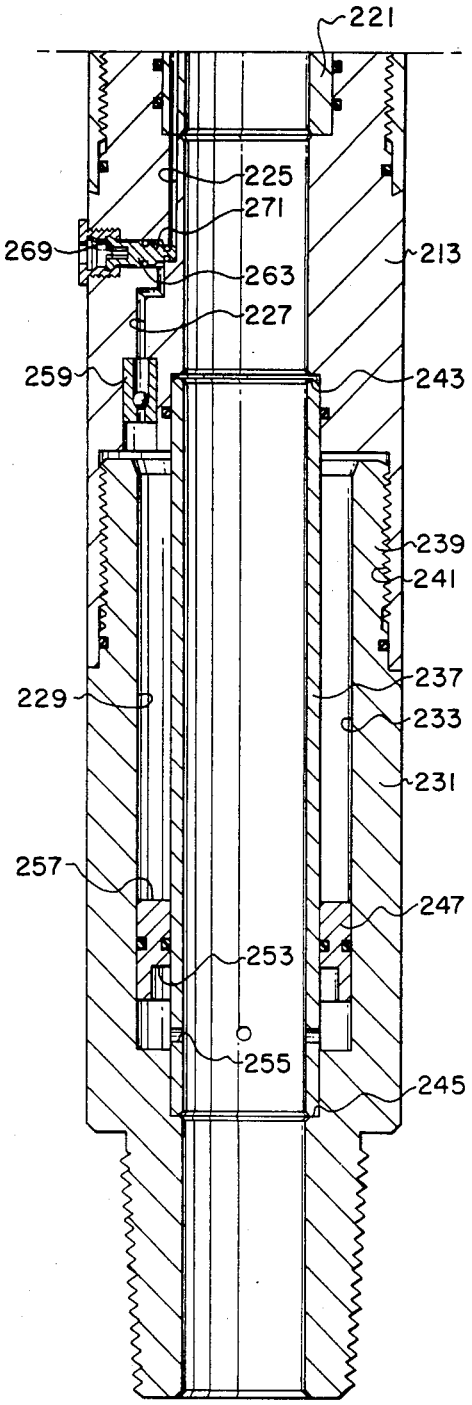
Figure 3A:
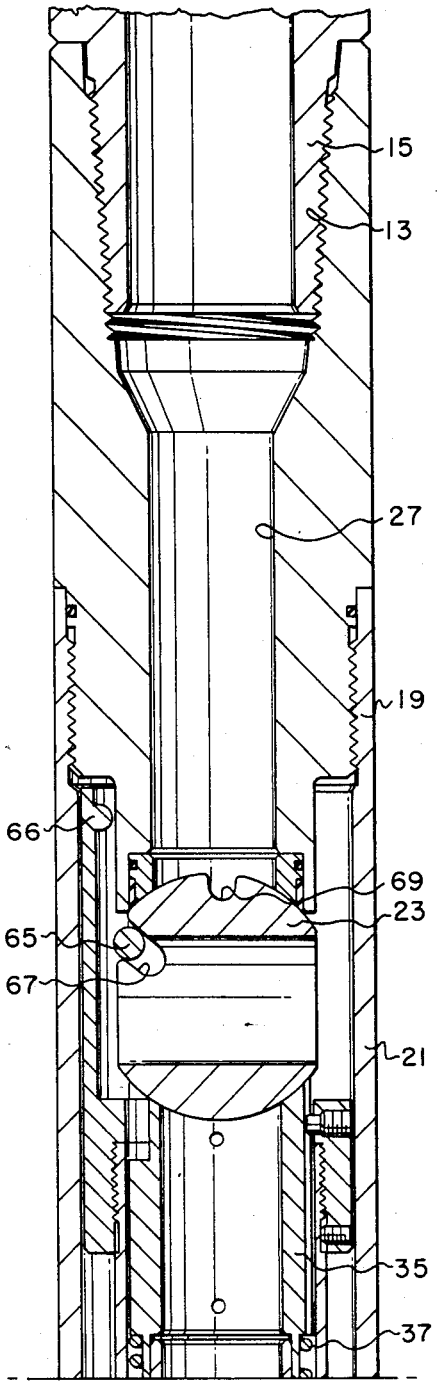
FIGS. 3A–3E are successive downward continuations showing side, cross-sectional views of the pressure operated test valve of the invention showing the device after a decrease in annulus fluid pressure has effected the reclosing of the ball valve of the device.
Figure 3B:
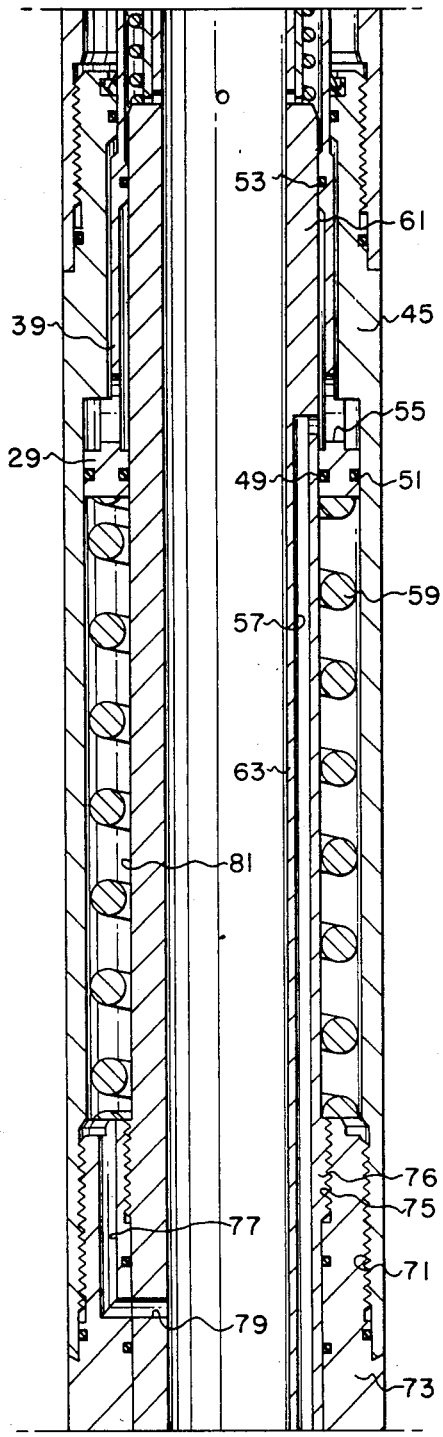
Figure 3C:
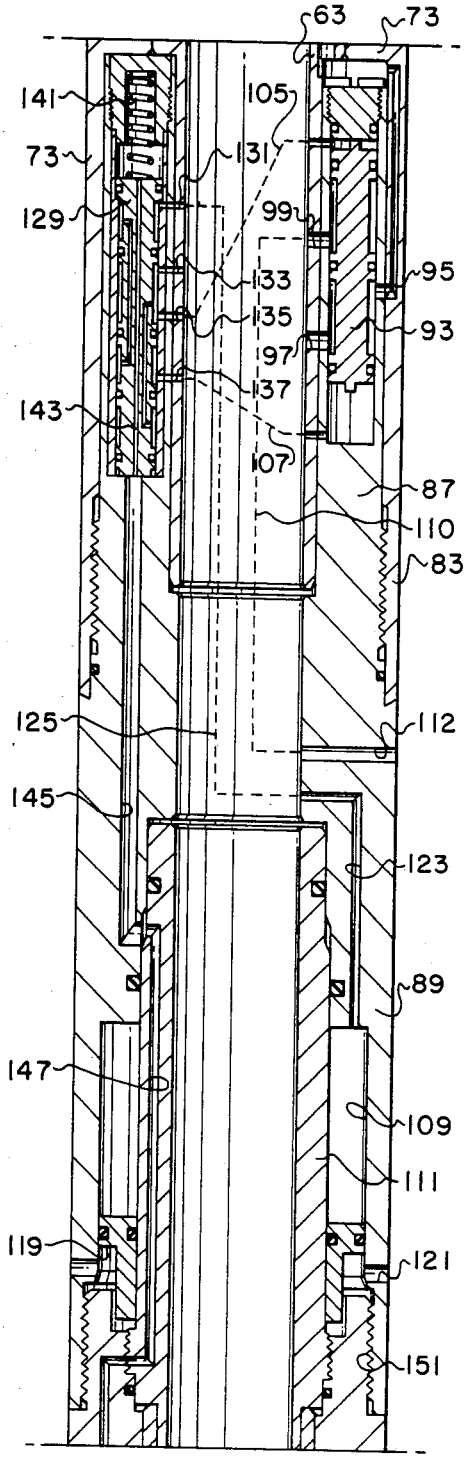
Figure 3D:
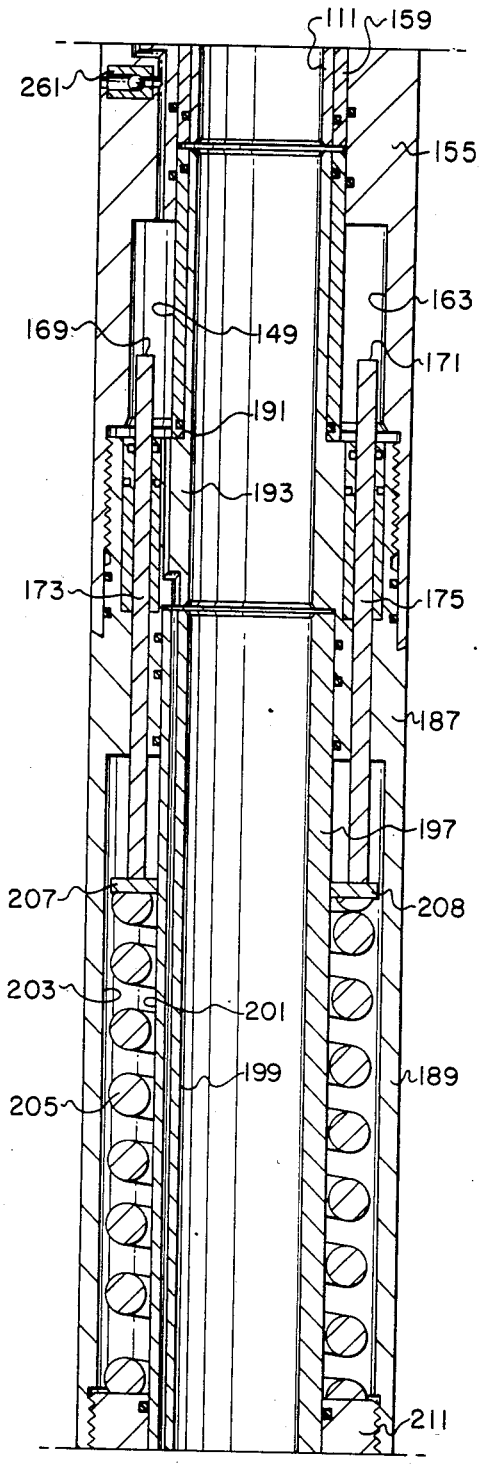
Figure 3E:
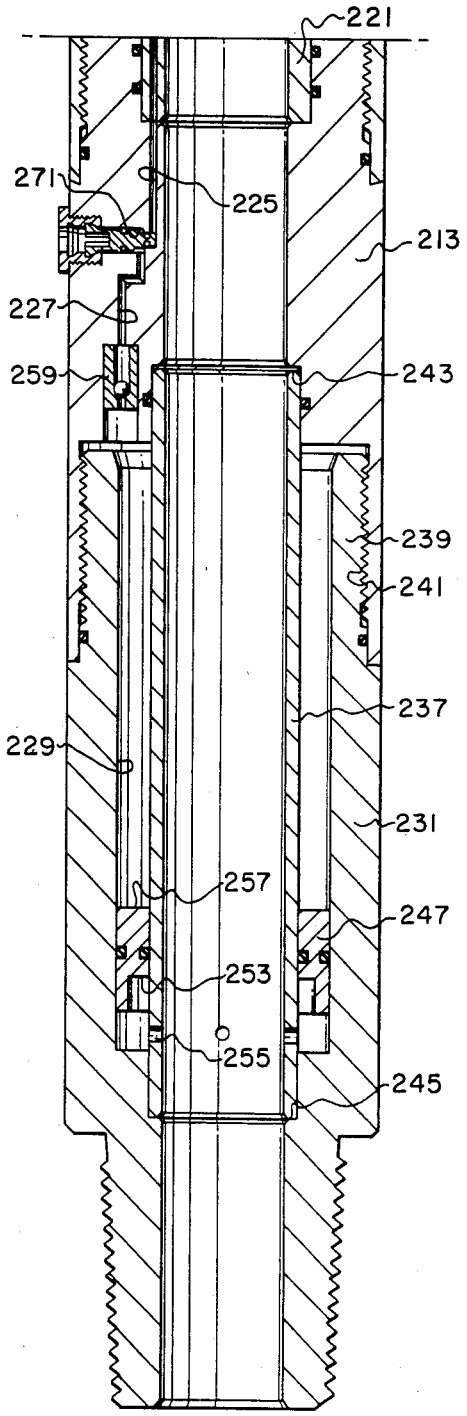

As the control fluid pressure increases, the displacement pistons (163, 165 in FIG. 1D) are moved downwardly in the direction shown in FIG. 2D to thereby compress the coil spring 205 located within the atmospheric chamber 203.

The well hydrostatic pressure which is present at the orifice 255 and which acts upon the floating piston 247 is also present at ports 121 (FIG. 1C) and orifice 112. Hydrostatic pressure thus acts upon the face 119 of the isolation piston 113, compressing the fluid in the power fluid reservoir 109. Well fluid present at the orifice 112 is communicated to port 99 of the power valve 93 but, in the position shown in FIG. 1C, is not allowed to pass to the port 95 and hence to the ball piston for shifting the ball. In order to shift the ball 23, it is necessary to first shift the power valve 93 to the position shown in FIG. 2C. Upon shifting the power valve 93, well fluid present at the orifice 112 is communicated through port 99 and through port 95 through passage 57 to the pressure responsive area 55 of the ball piston 29 to shift the ball.

In order to shift the power valve 93 from the position shown in FIG. 1C to the position shown in FIG. 2C, it is first necessary to shift the control valve 129. The control valve 129 is shifted from the position shown in FIG. 1C to the position shown in FIG. 2C by an increase in power fluid pressure within the chamber 109 which is communicated through conduit 125 to the pressure responsive annular area 127 of the control valve. However, during the running-in operation shown in FIGS. 1A–1E, the fluid pressure in the control fluid in passage 145 and chamber 139 is equal to the well hydrostatic pressure acting through ports 121 upon the power fluid in reservoir 109. Because the upper end of the control valve is a larger diameter than the lower extent thereof, movement of the control valve upwardly results in a volume displacement of control fluid within the control fluid reservoir which resists movement of the control valve during the running-in operations. Also, spring 141 holds the control valve in the downward position, until the annulus pressure overcomes the spring force.

Once the test depth is reached, the packer (16 in FIG. 4) is set and the well annulus above the packer is pressured up from the surface. Because the packer 16 isolates the internal bore of the tool from the increasing pressure in the well annulus above the packer, the increased pressure is not communicated to the orifices (255 in FIG. 1E) in the interior bore of the tool. Increased pressure in the well annulus above the packer causes the collet-piston 263 to be crammed inwardly, locking the collet-piston into the position shown in FIG. 2E and thereby locking the well hydrostatic pressure within the control fluid reservoir. A predetermined increase in the well annulus pressure from the surface now causes the isolation piston 113 to compress the power fluid in chamber 109, thereby causing the fluid to act upon the pressure responsive area 127 to move the control piston to the position shown in FIG. 2C.

Upward movement of the control piston 129 causes power fluid to be vented from the power chamber 91 and supplies control fluid through the conduit 105 to the piston face 101 to shift the power value 93 to the position shown in FIG. 2C. Shifting the power value 93 communicates port 99 with port 95 and thereby opens a fluid passage to allow well fluids present at the orifice 112 to be communicated to the ball piston 29 to shift the piston downwardly to the position shown in FIG. 2B. Downward movement of the ball piston 29 compresses the ball spring 59 as shown in FIG. 2B.

Downward movement of the ball piston 29 moves the ball valve 23 to the open position shown in FIG. 2A and hence the fluids produced by the formation to be tested are allowed to flow into the bore of the test tool and upwardly through the test string to the well head, if desired. The pressure of the formation fluids can also be measured by recorders which are provided within the test string as shown in FIG. 4.

A typical drill stem test involves opening the ball valve 23 for a predetermined period, measuring flow rates and pressures, followed by closing the ball valve and measuring the resulting formation pressure, then reopening the valve, etc. It is not uncommon to open and close the valve a number of times in order to provide sufficient test readings.

FIGS. 3A–3E illustrate the test device with the ball valve 23 in the closed position. In order to close the ball valve 23, it is only necessary to reduce the pressure in the well annulus above the packer to the original reference level. When the annulus pressure is relieved, the lack of pressure on the isolation piston 113 allows the coil spring 141 (FIG. 3C) to return the control valve 129 to its original position. Movement of the control valve 129 to the position shown in FIG. 3C vents the power fluid in the area above the piston face 101 through port 133 to the interior bore of the tool, allowing the power valve 93 to return to its original position. This opens the fluid passage 57 leading to the ball piston 29 to the interior bore of the tool through port 97. The ball spring (59 in FIG. 3B) then provides the sole closing force for driving the ball piston 29 upwardly and rotating the ball valve 23 to the closed position shown in FIG. 3A.

The pressure operated valve can again be opened by increasing the annulus pressure to a level sufficient to shift the control valve 129. Once testing is complete, the packer is released and the device can be retrieved to the surface. The check valve 261 vents the trapped hydrostatic pressure from the control fluid reservoir to the well annulus. Check valve 261 also serves as a pressure relief valve, in case downhole temperatures cause excessive pressure within the control fluid reservoir.

An invention has been provided with several advantages. The test value of the invention can be opened and closed without any manipulation of the well tubing string from the surface. Because the well hydrostatic pressure is trapped within the device at the test depth, it is not necessary to preload a compressible gas as a reference pressure for operation of the device. Because the tool does not require charging with high pressure gas, danger to operating personnel is reduced. Also, because the reference gas pressure does not have to be calculated at the surface, variations in well temperature and pressure do not effect the operation of the device. Instead of using a compressible gas to oppose the movement of the ball piston, eight displacement pistons act against a coil spring in atmospheric chamber to absorb the volume displacement of control fluid. This arrangement provides a safe and reliable mechanism for repeatedly opening and closing the ball valve using only well annulus pressure.

While the invention has been shown in only one of its forms, it is not thus susceptible to various changes and modifications without departing from the spirit thereof.

I claim:

1. A pressure operated test valve for use in a well test string in a well bore, the test string having a packer arranged for sealing the well bore to isolate the annulus between the well bore and the test string above the packer from that portion of the well bore below the packer, comprising:

a rotating ball valve movable between open and closed positions relative to the interior of the test string;

a ball piston for shifting said rotating ball between said open and closed positions;

biasing means for urging said ball piston to its valve closing position;

a power fluid reservoir containing a power fluid;

an axially shiftable power valve located within a power chamber, said power valve having opposed piston faces exposed by means of fluid passageways to fluid in said power fluid reservoir; and an axially slidable control valve located within a control chamber, said control valve having a pressure responsive annular area exposed to said power fluid for shifting said control valve and having internal passages for supplying pressurized power fluid to a selected face of said power valve to shift said power valve between a first position which isolates said ball piston and a second position which exposes said ball piston to annulus fluid pressure for shifting said ball to said open position.

2. A pressure operated test valve for use in a well test string in a well bore, the test string having a packer arranged for sealing the well bore to isolate the annulus between the well bore and the test string above the packer from that portion of the well bore below the packer, comprising:

a rotating ball valve movable between open and closed positions relative to the interior of the test string;

a ball piston for shifting said rotating ball between said open and closed positions;

biasing means for urging said ball piston to its valve closing position;

a power fluid reservoir containing a power fluid;

an axially shiftable power valve located within a power chamber, said power valve having opposed piston faces exposed by means of fluid passageways to fluid in said power fluid reservoir;

an axially slidable control valve located within a control chamber, said control valve having a pressure responsive annular area exposed to said power fluid for shifting said control valve and having internal passages for supplying pressurized power fluid to a selected face of said power valve to shift said power valve between a first position which isolates said ball piston and a second position which exposes said ball piston to annulus fluid pressure for shifting said ball to said open position; and a control fluid reservoir containing an isolated control fluid, said control fluid reservoir being connected to said control chamber whereby movement of said control valve within said control chamber results in a volume displacement of control fluid within said control fluid reservoir.

3. The pressure operated test valve of claim 2 wherein said power fluid and said control fluid are substantially incompressible liquids.

4. The pressure operated test valve of claim 3, wherein said power valve is a two position, three port valve.

5. The pressure operated test valve of claim 3, wherein said control valve is a two position, four port valve.

6. A pressure operated test valve for use in a well test string in a well bore, the test string having a packer arranged for sealing the well bore to isolate the annulus between the well bore and the test string above the packer from that portion of the well bore below the packer, comprising:

a rotating ball valve movable between open and closed positions relative to the interior of the test string;

a ball piston for shifting said rotating ball between said open and closed positions;

biasing means for urging said ball piston to its valve closing position;

a power fluid reservoir containing a power fluid;

an axially shiftable power valve located within a power chamber, said power valve having opposed piston faces exposed by means of fluid passageways to fluid in said power fluid reservoir;

an axially slidable control valve located within a control chamber, said control valve having a pressure responsive annular area exposed to said power fluid for shifting said control valve and having internal passages for supplying pressurized power fluid to a selected face of said power valve to shift said power valve between a first position which isolates said ball piston and a second position which exposes said ball piston to annulus fluid pressure for shifting said ball to said open position;

a control fluid reservoir containing an isolated control fluid, said control fluid reservoir being connected to said control chamber whereby movement of said control valve within said control chamber results in a volume displacement of control fluid within said control fluid reservoir; and pressure responsive means for maintaining the pressure of said control fluid at the level of the well hydrostatic pressure prior to setting said packer to thereby resist the volume displacement caused by movement of said control valve and for locking the well hydrostatic pressure into said control fluid reservoir after setting said packer, whereby shifting said control valve requires further pressurization of said control fluid above the existing well hydrostatic pressure.

7. A pressure operated test valve for use in a well test string in a well bore, the test string having a packer arranged for sealing the well bore to isolate the annulus between the well bore and the test string above the packer from that portion of the well bore below the packer, comprising:

a rotating ball valve movable between open and closed positions relative to the interior of the test string;

a ball piston for shifting said rotating ball between said open and closed positions;

biasing means for urging said ball piston to its valve closing position;

a power fluid reservoir containing a power fluid;

an axially shiftable power valve located within a power chamber, said power valve having opposed piston faces exposed by means of fluid passageways to fluid in said power fluid reservoir;

an axially slidable control valve located within a control chamber, said control valve having a pressure responsive annular area exposed to said power fluid for shifting said control valve and having internal passages for supplying pressurized power fluid to a selected face of said power valve to shift said power valve between a first position which isolates said ball piston and a second position which exposes said ball piston to annulus fluid pressure for shifting said ball to said open position;

a control fluid reservoir containing an isolated control fluid, said control fluid reservoir being connected to said control chamber whereby movement of said control valve within said control chamber results in a volume displacement of control fluid within said control fluid reservoir;

pressure responsive means for maintaining the pressure of said control fluid at the level of the well hydrostatic pressure prior to setting said packer to thereby resist the volume displacement caused by movement of said control valve and for locking the well hydrostatic pressure into said control fluid reservoir after setting said packer, whereby shifting said control valve requires further pressurization of said control fluid above the existing well hydrostatic pressure; and a well fluid isolation piston in a piston chamber, said isolation piston having opposed piston faces, one of said faces being exposed to well hydrostatic pressure and the other of said piston faces being exposed to said power fluid for further pressurizing said power fluid to shift said control valve, power valve and ball piston.

8. The pressure operated test valve of claim 7, wherein said pressure responsive means includes a floating piston in a piston chamber, said floating piston having a first face exposed to tubing pressure within said tubing string and a second face exposed to control fluid in said control fluid reservoir.

9. The pressure operated test valve of claim 8, further comprising:

a fluid passage communicating control fluid from said control fluid reservoir to said floating piston second face; and metering means in a portion of said fluid passage for allowing the flow of control fluid pressurized by said floating piston into said control fluid reservoir, while resisting opposite relative flow of said pressurized control fluid.

10. The pressure operated test valve of claim 9, wherein said metering means is at least one check valve.

11. The pressure operated valve of claim 9, further comprising:

a plurality of spring loaded displacement pistons, each of said displacement pistons having a pressure responsive area exposed to control fluid pressure within said control fluid reservoir for absorbing the volume displacement caused by movement of said control valve within said control fluid reservoir.

* * * * *